US005618160A

United States Patent [19]

Harada et al.

[11] Patent Number: 5,618,160

[45] Date of Patent: Apr. 8, 1997

[54] TURBOMACHINERY WITH VARIABLE ANGLE FLUID GUIDING DEVICES

[75] Inventors: Hideomi Harada; Kazuo Takei, both of Kanagawa-ken, Japan

[73] Assignee: Ebara Corporation, Tokyo, Japan

[21] Appl. No.: 442,585

[22] Filed: May 17, 1995

[30] Foreign Application Priority Data

May 23, 1994 [JP] Japan ..... 6-132559
May 27, 1994 [JP] Japan ..... 6-138082

[51] Int. Cl.[6] ..... F04D 27/02

[52] U.S. Cl. ..... 415/17; 415/15

[58] Field of Search ..... 415/15, 17, 26, 415/36, 42, 46; 417/44.2

[56] References Cited

U.S. PATENT DOCUMENTS

| | | | |
|---|---|---|---|
| 2,470,565 | 5/1949 | Loss . | |
| 2,645,410 | 7/1953 | Bauger et al. . | |
| 3,362,624 | 1/1968 | Endress . | |
| 3,372,862 | 3/1968 | Koenig . | |
| 4,164,035 | 8/1979 | Glennon et al. | 415/17 |
| 4,288,198 | 9/1981 | Hibino et al. | 415/17 |
| 5,355,691 | 10/1994 | Sullivan et al. | 415/17 |

FOREIGN PATENT DOCUMENTS

| | | | |
|---|---|---|---|
| 0186332 | 7/1986 | European Pat. Off. . | |
| 2599436 | 12/1987 | France . | |
| 53-113308 | 3/1978 | Japan . | |
| 55-60692 | 5/1980 | Japan | 415/17 |
| 55-60695 | 5/1980 | Japan | 415/17 |
| 57-56699 | 4/1982 | Japan . | |
| 61-126399 | 6/1986 | Japan | 415/15 |
| 63-239398 | 10/1988 | Japan | 415/17 |
| 4-47197 | 2/1992 | Japan . | |
| 4-81598 | 3/1992 | Japan | 415/17 |
| 6-17788 | 1/1994 | Japan . | |
| 1058898 | 2/1967 | United Kingdom . | |
| 2193256 | 2/1988 | United Kingdom | 415/15 |

*Primary Examiner*—James Larson
*Attorney, Agent, or Firm*—Armstrong, Westerman, Hattori, McLeland & Naughton

[57] ABSTRACT

A turbomachinery is presented to provide stable operation at fluid flow rates much lower than the design flow rate without introducing surge in the device. This is achieved by providing a diffuser with variable angle vanes. The vane angle at low flow rates is adjusted so as to minimize the diffuser loss of the exiting fluid stream from the impeller. Since the flow angle of the exit flow of the impeller is a function only of the non-dimensional flow rates, and does not depend on the flow angle at the inlet the impeller, therefore, the vane angles can be regulated to achieve a stable operation of the impeller without producing surge of the turbomachinery at flow rates lower than the design flow rate. To optimize the performance of the turbomachinery, in addition to the variable angle vanes, an inlet guide vane having variable vane angle is provided so that the turbomachinery can be operated at the required flow rate and head pressure. The concept is demonstrated in a turbomachinery provided with variable diffuser vanes and an inlet guide vane.

13 Claims, 11 Drawing Sheets

TURBOMACHINERY WITH VARIABLE ANGLE FLUID GUIDING DEVICES

BACKGROUND OF THE INVENTION

1. Field of the Invention

The present invention relates in general to a turbomachinery such as centrifugal and mixed flow pumps, gas blowers and compressors, and relates in particular to a turbomachinery having variable angle flow guiding devices.

2. Technical Background

When conventional centrifugal and mixed flow pumps are operated at flow rates lower than the design flow rate of the pump, flow separation occurs at locations such as impeller and diffuser causing lowering in the rate of pressure rise to generate instability in the piping such as a phenomenon called "surge" to disable the operation.

A conventional approach to resolving such problems is to provide a bypass piping (blow-off for blowers and compressors) so that when a low flow rate to the pump threatens instability in the operation of the pump, a bypass pipe can be opened to maintain the flow to the pump for maintaining the stable operation and reduce the flow to the equipment.

However, according to this method, it is necessary beforehand to estimate the flow rate to cause an instability in the operation of the pump, and to take a step to open a valve for the bypass pipe when this flow rate is reached. Therefore, according to this method, the entire fluid system cannot be controlled accurately unless the flow rate to cause the instability is accurately known. Also, it is necessary to know the operating characteristics of the turbomachinery correctly at various rotational speeds of the pump in order to properly control the entire fluid system. Therefore, if the operation involves continuous changes in rotational speed of the pump, such a control technique is unable to keep up with the changing conditions of the pump operation.

Furthermore, even if the instability point is avoided by activating the valve on the bypass pipe, the operating conditions of the pump itself does not change, and the pump operates ineffectively, and it presents a wasteful energy consumption. Further, this type of approach requires installation of bypass pipes and valves, and the cost of the system becomes high.

SUMMARY OF THE INVENTION

The present invention was made in view of the problems in the existing technology, and an objective is to present a turbomachinery, having variable angle diffuser vanes, capable of being operated over a wide flow rates by preventing the phenomenon of instability caused by operation of the device at flow rates below the design flow rate.

The objective is achieved in a turbomachinery comprising: an impeller for providing energy to a fluid medium and sending the fluid medium to a diffuser; diffuser vanes having variable angle vanes provided on a diffuser for increasing a fluid pressure of the fluid medium; a rotation device for driving said diffuser vanes; a flow rate detection device for detecting inlet flow rates, wherein an operating angle of the diffuser vanes is determined from an inlet flow rate detected by the flow rate detection device in accordance with a pre-determined relationship between inlet flow rates and diffuser vane angles, and a controller is operated to drive the rotation device to position said diffuser vanes at said operating angle.

According to the turbomachinery, the impeller drives the fluid medium into the diffuser at a flow rate which may be below the design flow rate. The turbomachinery detects the inlet flow rate to the turbomachinery, and determines and sets an optimum vane angle on the diffuser vanes on the basis of a pre-determined relationship between the inlet flow rates and the diffuser vane angles. Therefore, the device can be operated even at flow rates lower than the design flow rate for the device.

This aspect of the invention is based on the following considerations.

FIG. 1 shows a schematic illustration of the fluid flow near the exit of the impeller of a turbomachinery (compressor). The flow directions of the streams flowing out of the impeller 2 are shown by three arrows labelled A (at design flow rate), B (at low flow rate) and C (at high flow rate). As can be seen clearly from this drawing, at flow rates other than the design flow rate, there is misdirecting in the flow stream with respect to the orientation of the diffuser vane. At the high flow rate C, the flow has the negative incidence angle on the pressure side of the diffuser vane 3*a* of the diffuser 3; and at the low flow rate, it has the positive incidence angle on the suction side of the diffuser vane 3*a*. This condition produces flow separation, thus leading to the condition shown in FIG. 2 that the diffuser loss increases at both higher and lower flow rates than the design flow rate. When the flow rate becomes too low, an instability sets in, and if the flow rate is reduced still further, surge can occur. Surge induces a large variation in the fluid pressure in the piping, and eventually leads to inoperation of the pump.

This problem can be resolved by making the vane angle of the diffuser variable, and if the vane angle is adjusted to suit the flow angle of the exit flow of the impeller, for example arrow B in FIG. 1, then the diffuser loss is decreased as shown by the dashed line in FIG. 2 even to the very low flow rates. Therefore, an onset of instability is avoided, thus enabling to operate the pump stably at low flow rates and improving the overall performance of the pump as shown by the dashed line in FIG. 3.

According to the present investigation of the effects of the diffuser vanes, the optimum angle of the diffuser vane at the exit region of the impeller with regard to the non-dimensional inlet flow rate of the impeller is approximately linear as shown in FIG. 4. It was demonstrated that surge phenomenon can be avoided by controlling the diffuser vane angle down to zero flow rate.

For a pump, the relationship between the flow rate at different rotational speeds and the diffuser vane angle can be approximated by a straight line ($N_1$ in FIG. 4). For a compressor, the relationship between the flow rate at different rotational speeds and the diffuser angle is dependent on the rotational speed. As shown in FIG. 4, at different speeds, $N_2, \ldots N_4$, there are respective different linear relationships due to the compressibility of the gases. The slope of the lines can be computed using experimental results or by assuming certain conditions at the impeller exit.

From these results, it can be seen that if a non-dimensional inlet flow rate of a pump can be found under an operating condition, an optimum diffuser vane angle to suit this flow rate can be found for any type of turbomachineries.

As a result, it becomes possible to avoid the onset of surge and provide a stable operation of the turbomachinery, by using the non-dimensional original inlet flow rate and obtaining the diffuser vane angle therefrom, and determining an optimum diffuser vane angle and setting this angle on the diffuser vane using a controller to regulate the diffuser vane angle.

Another aspect of the present invention is a turbomachinery comprising: an impeller for providing energy to a fluid medium and sending said fluid medium to a diffuser; an inlet guide vane disposed upstream of said impeller; an operating parameter input device for inputting operating parameters required for achieving a specified operating condition of said turbomachinery; a computing processor for computing an operating angle of said inlet guide vane from an inlet flow rate and a head value measured by sensors so as to achieve said specified operating condition; and a first drive controller for operating said inlet guide vane so as to position said inlet guide vane at said operating angle computed by said computing processor.

This aspect of the invention is based on the following considerations.

All turbomachineries can be treated similarly once the operating conditions are defined. FIG. 5 is a graph to explain the relationship between the pump characteristics and the system resistance curve. It is assumed, at the start, that the performance of the pump when the inlet guide vane angle is zero is known.

First, the flow rate Q and the head value H for the required operation of the pump are used to calculate the flow coefficient $\phi(=4Q/(\pi D_2^2 U_2^2))$ and the pressure coefficient $\psi(=gH/U_2^2)$.

By assuming that the curve passing through the operating point ($\phi$, $\psi$) and the origin is a curve of second order, (if there is a fixed system resistance, this is obtained from the intercept on the $\psi$-axis), the coefficient of the curve is obtained. The co-ordinates ($\phi'$,$\psi'$) of the intersection point of the curve with the known performance curve of the pump at zero vane angle is obtained by computation or other method.

From the value of $\phi'$, the flow rate Q' is obtained by the following equation.

$$Q'=\phi'\pi D_2^2 U_2/4$$

Letting the area of the impeller be $A_1$, the following equation provides the inlet axial velocity component $Cm_1$ at the impeller from the following equation:

$$Cm_1=Q'/A_1=\phi'\pi D_2^2 U_2/4A_1$$

The head value H' for the pump is obtained from the difference in a product $U_2Cu_2$ which is a product of the tip speed $U_2$ at the impeller and the tangential component $Cu_1$ of the absolute velocity and a product $U_1Cu_1$ which is the product of the speed $U_1$ at the impeller inlet and the tangential component $Cu_1$ of the absolute velocity from the following equation:

$$H'=(U_2Cu_2-U_1Cu_1)/g$$

here, $$\psi'=gH'/U_2^2,$$

therefore, $$\psi'=(U_2Cu_2-U_1Cu_1)/U_2^2$$

is obtained.

Since, the inlet guide vane angle is zero, the tangential component $Cu_1$ of the absolute velocity is zero. Therefore, the tangential component $Cu_2$ of the absolute velocity at the impeller exit is given by the following equation:

$$Cu_2=U_2\psi'$$

According to the present investigation, it was found that the tangential component $Cu_2$ of the absolute velocity depends only on the flow rate, and is independent of the inlet guide vane angle.

Using these results, the value of the operational parameter is given by:

$$\begin{aligned}\psi &= (U_2^2\psi' - U_1Cu_1)/U_2^2\\ &= \psi' - U_1Cu_1/U_2^2\end{aligned}$$

Therefore, the tangential component $Cu_1$ of the absolute velocity is given by:

$$Cu_1=(\psi'-\psi)U_2^2/U_1$$

The angle of the inlet guide vane to satisfy the operating parameters is given by:

$$\begin{aligned}\alpha &= \arctan(Cu_1/Cm_1)\\ &= \arctan(A_1(\psi'-\psi)U_2/(D_2^2\phi' U_1))\\ &= \arctan(A_1(\psi'-\psi)U_2/D_2D_1\mathrm{rms}\phi')\end{aligned}$$

where $D_1$rms is the root mean square diameter at the impeller inlet, and defining $$k=A_1/(D_2D_1\mathrm{rms})$$

then, $$\alpha_1=\arctan(k(\psi'-\psi)/\phi')$$

is obtained.

According to the turbomachinery present above, by inputting a required conditions such as a flow rate Q or head H, the most suitable inlet guide vane angle is calculated in accordance with the formula above, so that the turbomachinery can be operated to exhibit its best performance.

DESCRIPTION OF THE PREFERRED EMBODIMENTS

In the following, an embodiment of a turbomachinery having the variable angle vanes of the present invention will be presented with reference to FIGS. 6 to 10.

Figure 1:
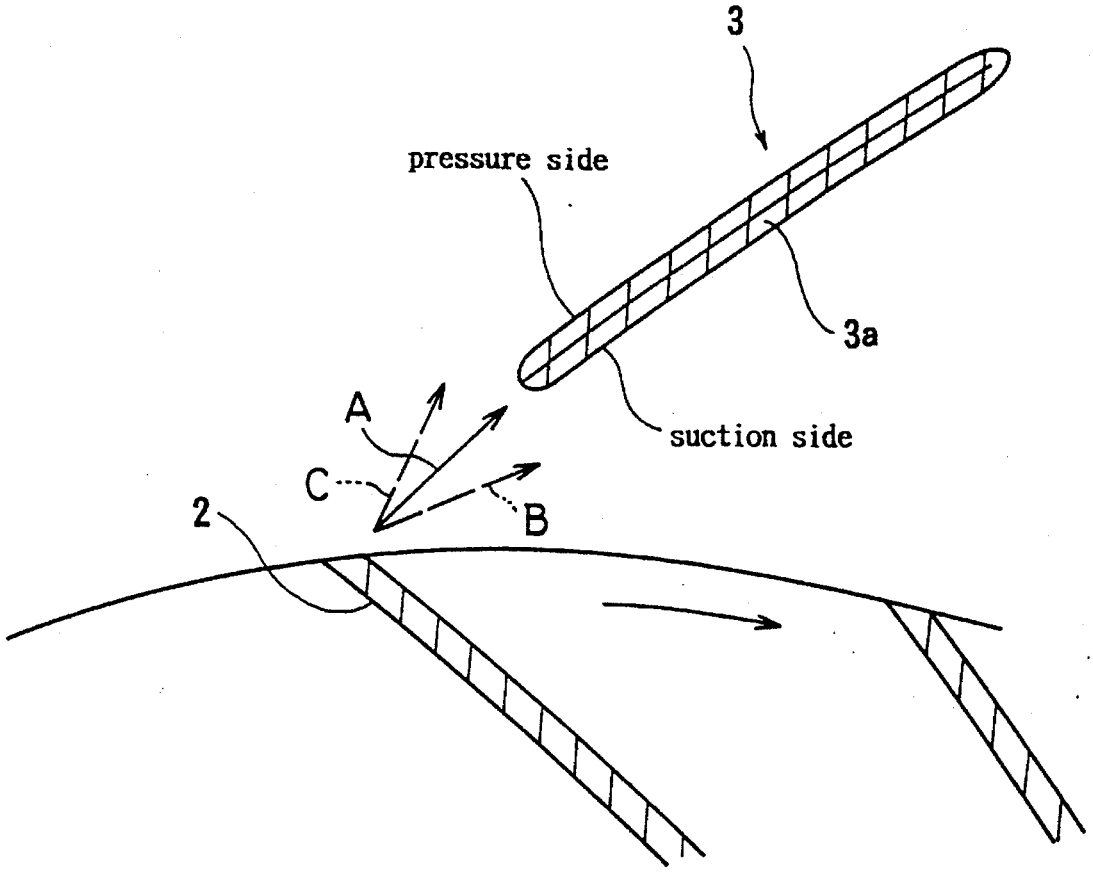
FIG. 1 is a schematic illustration of the fluid flow conditions existing at the exit region of the impeller.
Figure 2:
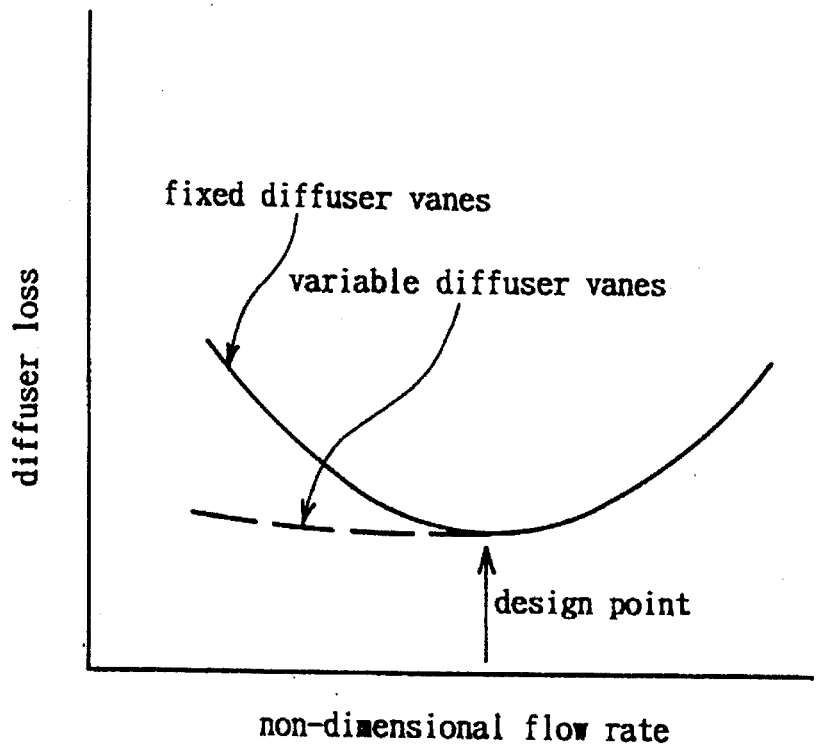
FIG. 2 illustrates a relationship between the on-dimensional flow rate and the diffuser loss.
Figure 3:
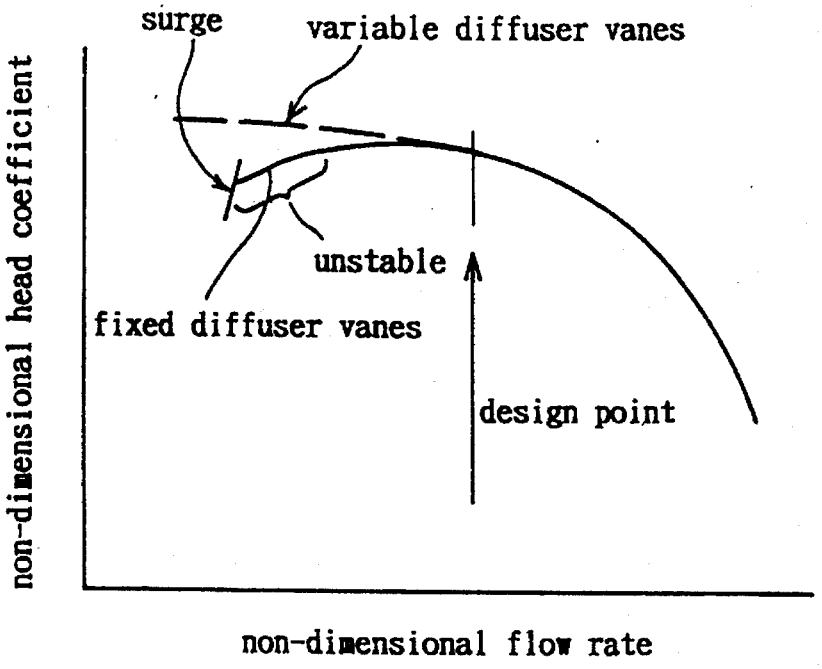
FIG. 3 illustrates a relationship between the non-dimensional flow rate and the non-dimensional head coefficient.
Figure 4:
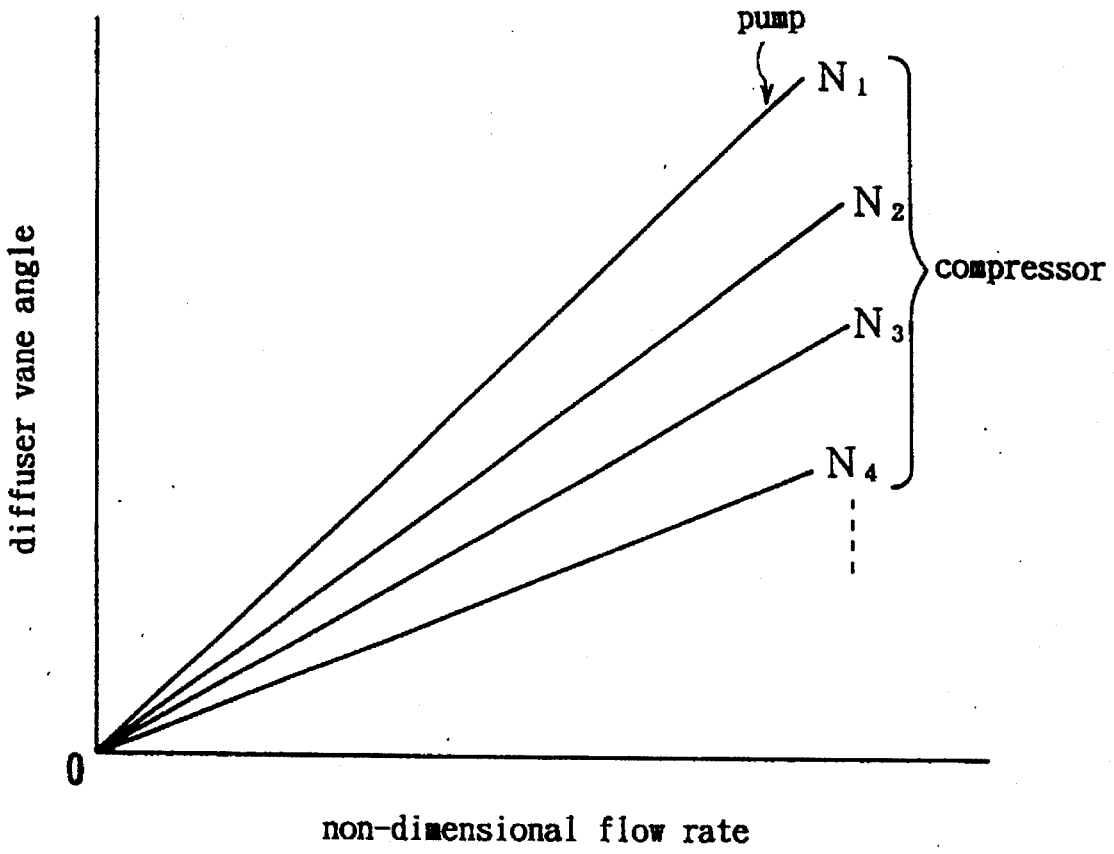
FIG. 4 illustrates a relationship between the non-dimensional flow rate and the diffuser vane angle.
Figure 5:
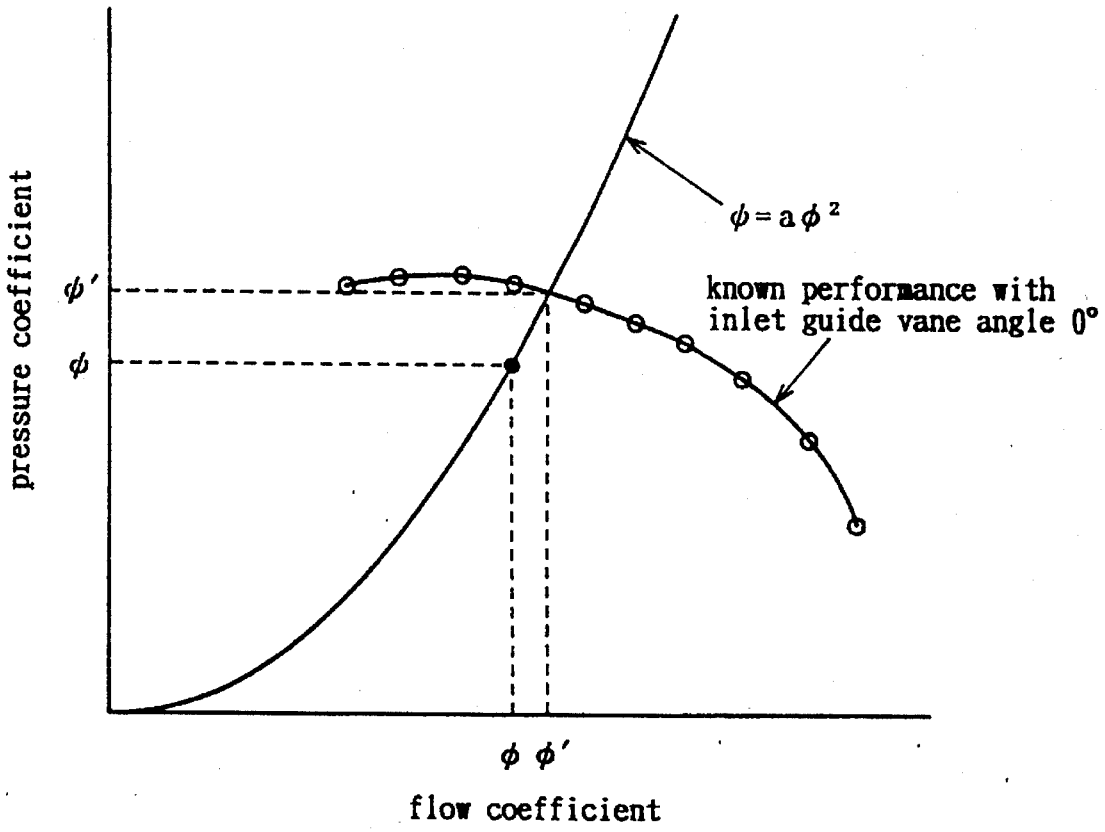
FIG. 5 is a graph to explain a performance of the pump and a system resistance curve of the pump.
Figure 6:
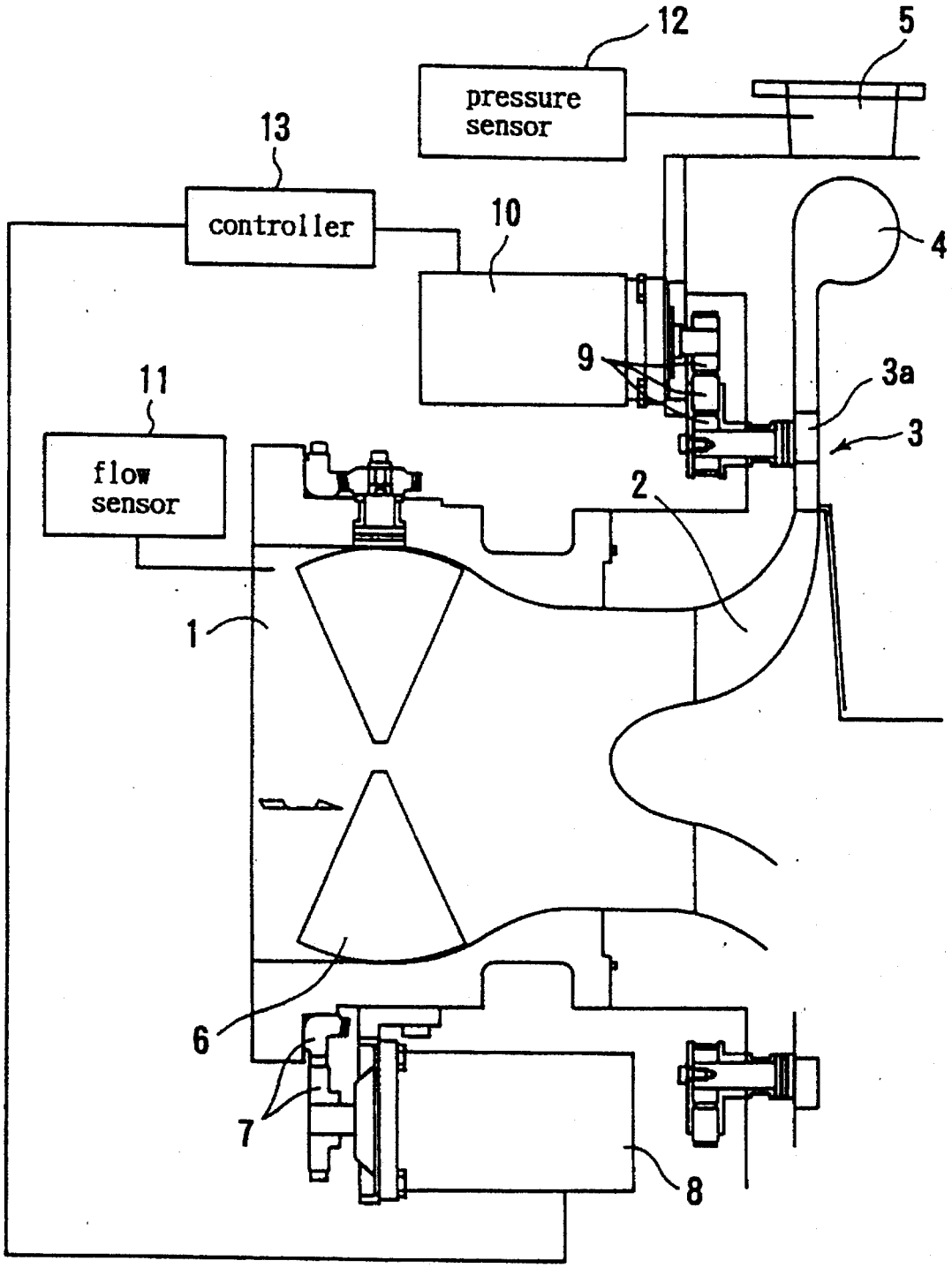
FIG. 6 is a cross sectional view of an embodiment of a turbomachinery having variable angle vanes for a single-stage centrifugal compressor.
Figure 7:
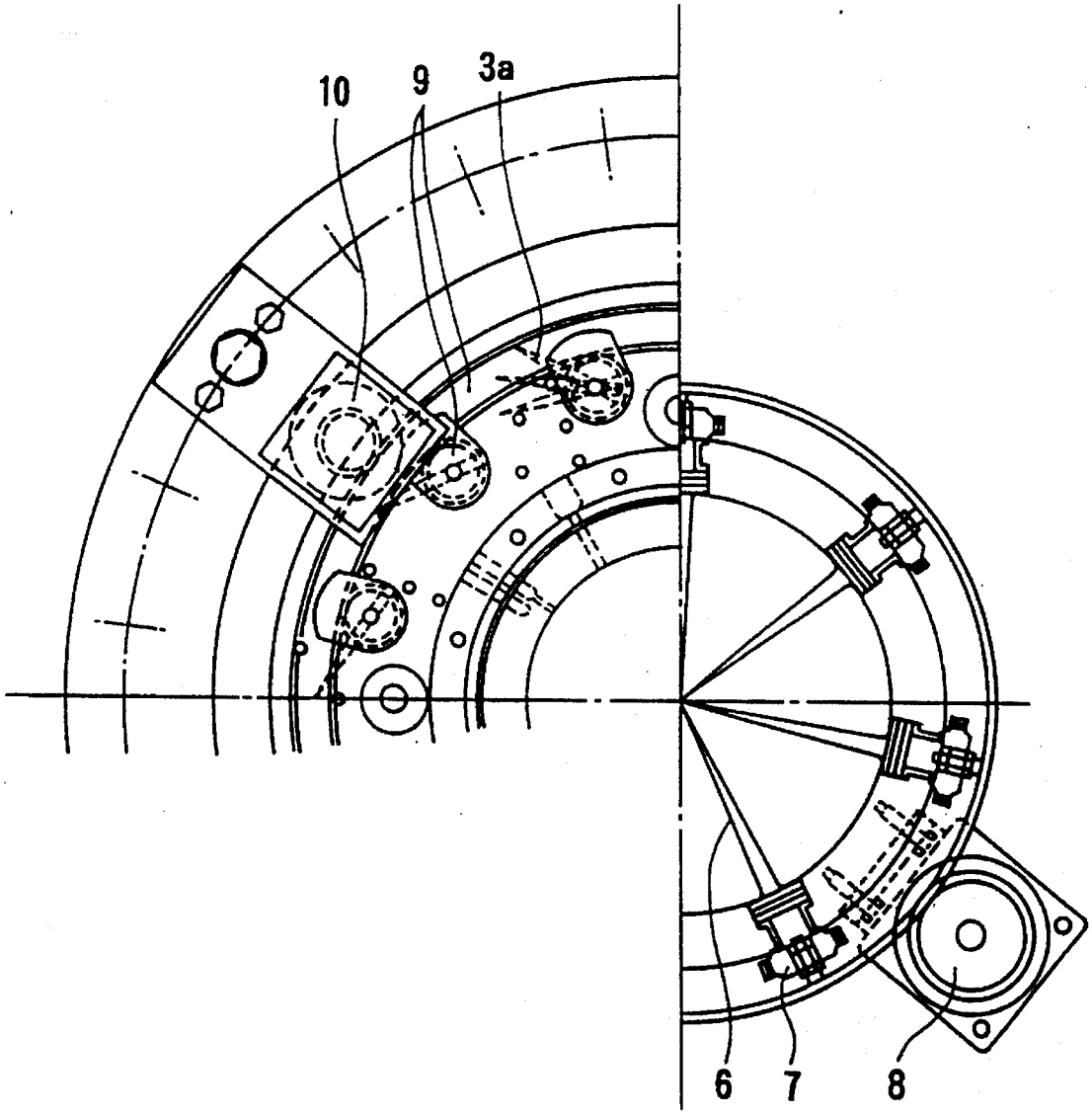
FIG. 7 is a detailed partial side view of the actuator shown in FIG. 6.

FIGS. 6 and 7 show a single-stage centrifugal turbomachinery applicable to the variable angle vanes, where FIG. 6 is a cross sectional view of the turbomachinery and FIG. 7 is a partial side view of the device. The turbomachinery accepts a fluid stream from a suction pipe 1, and an impeller 2 provides energy to the fluid stream to forward the stream to a diffuser 3 to increase its pressure. The pressurized stream is discharged from a scroll 4 to the discharge pipe 5. In the suction pipe 1, a plurality of fan-shaped inlet guide vanes 6 are disposed along the peripheral direction and are operatively connected to an actuator 8 by way of a transmission device 7. The diffuser 3 disposed downstream of the impeller 2 has diffuser vanes 3*a* which are also operatively connected to an actuator 10 by way of a transmission device 9. The suction pipe 1 is provided with a flow sensor 11 to measure the inlet flow rate, and the discharge pipe 5 is provided with a pressure sensor 12 for measuring the discharge pressure (head). There is a controller 13 for operating the actuators 8, 10, and the output terminals of the flow sensor and pressure sensor are electrically connected thereto.

Figure 8:
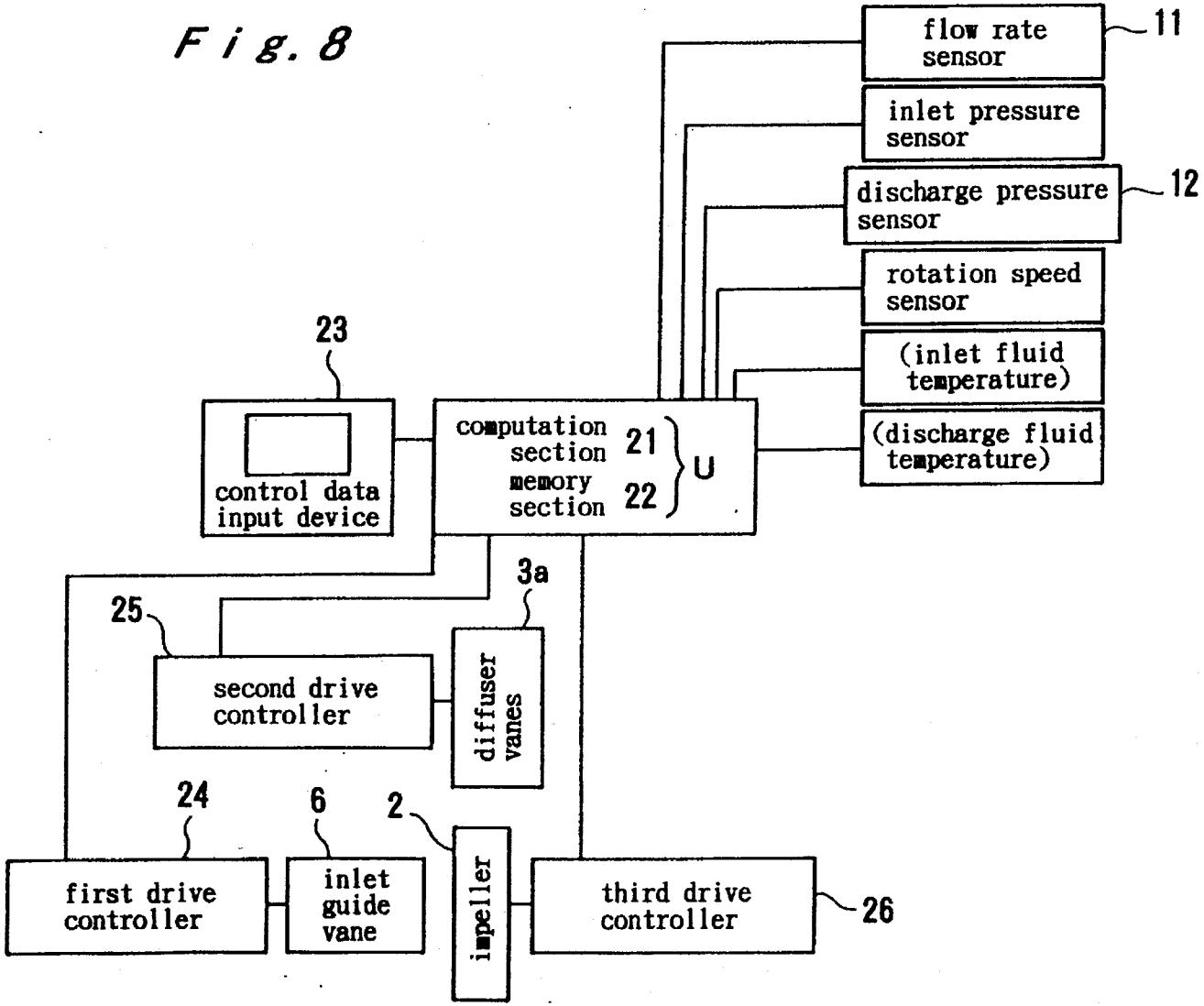
FIG. 8 is a flow chart showing the processing steps of the turbomachinery of this invention.

FIG. 8 shows a block diagram of the configuration of the controller 13. As shown in this figure, the turbomachinery having variable angle vanes comprises: a computing processor section U including a computation section 21 for measuring the rotational speed of the turbomachinery, inlet flow volume and rise in the head and determining the optimum angle of the diffuser vane 3*a* for the inlet flow volume, and a memory section 22 for storing previously determined operating parameters of the turbomachinery when the inlet guide vanes are fully open; an input device 23 for inputting the necessary operating parameters for the turbomachinery; a first drive control device 24 for controlling the angle of the inlet guide vane 6; a second drive control device 25 for controlling the angle of the diffuser vanes 3*a*; and a third drive control device 26 for controlling the rotational speed of the impeller 2, i.e. the rotational speed of the turbomachinery.

The turbomachinery is designed to operate so that the device can be operated under the necessary operating parameters input by the input device 23. This is achieved by using the computing processor U, comprising the computation section 21 and the memory section 22, so that the angle for the inlet guide vane 6 can be determined and the inlet guide vanes 6 is operated to position the vane 6 to the angle thus determined, operate the diffuser vanes 3*a* so that the diffuser vanes 3*a* are set to a suitable angle depending on the inlet flow rate, and control the rotational speed of the turbomachinery to provide a stable operation. The diffuser vane angle adjustment will be described later.

Figure 9:
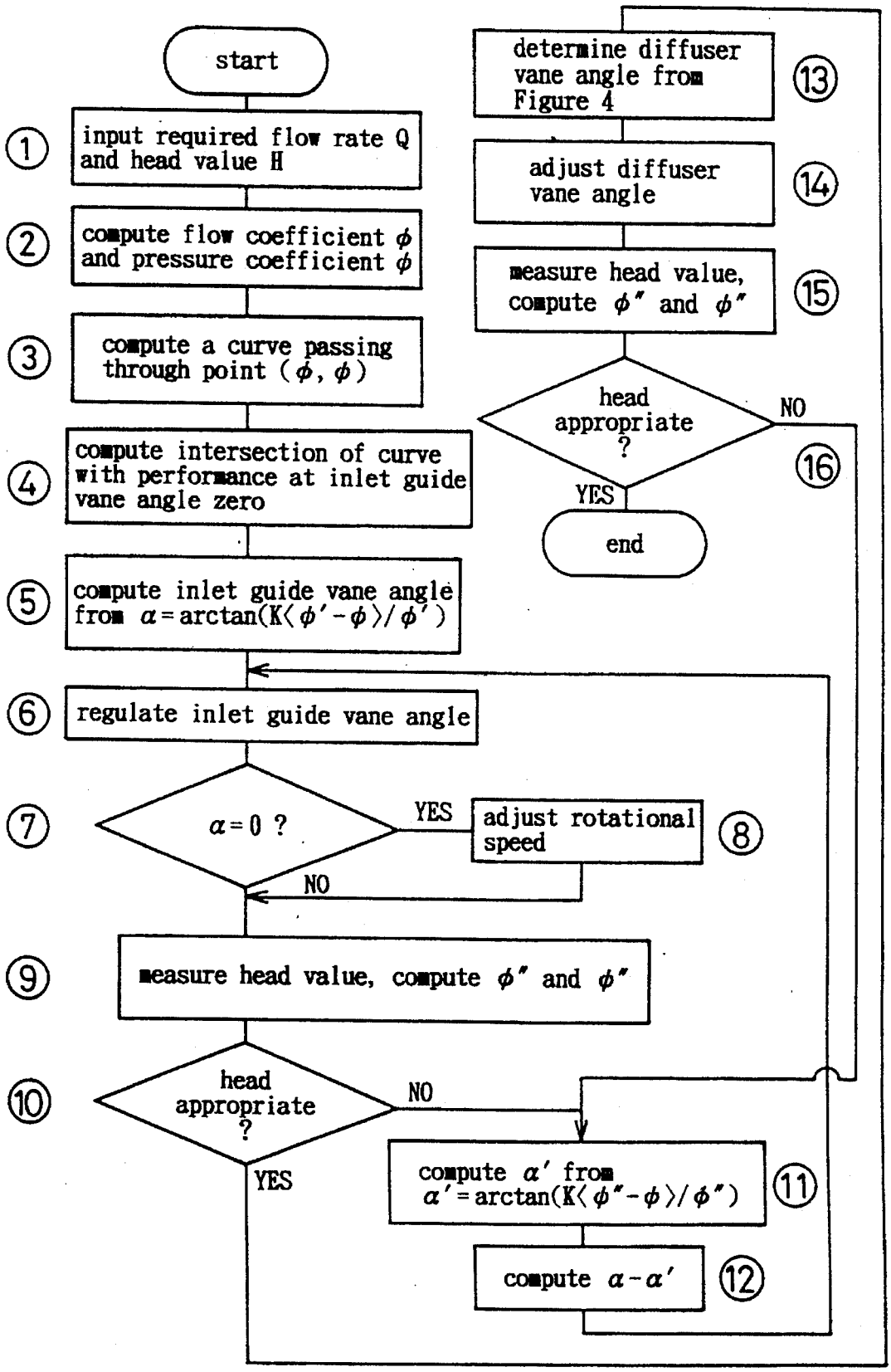
FIG. 9 is a logic flow chart for determining the flow rate.

FIG. 9 is a flow chart for the turbomachinery so that it can be operated at its maximum operating efficiency under the operating conditions specified without introducing surge in the operating system. This is achieved by setting the angle of the inlet guide vane 6 to the proper angle required to operate the device to meet the required operating conditions while setting the diffuser vanes 3*a* to prevent surge in the turbomachinery. The angle $\alpha$ for the inlet guide vane 6 is determined in terms of the operational parameters: the rotational speed N of the impeller 2, the required flow rate Q and head H.

If the turbomachinery is provided with a variable rotational speed capability, a suitable speed is pre-entered into the device. In step 1, the required flow rate Q and head H are entered; in step 2, the flow coefficient $\phi$, and the pressure coefficient $\psi$ are computed. Next, in step 3, a curve of second order to pass through the flow coefficient $\phi$, and the pressure coefficient $\psi$ are computed; and in step 4, the point of intersection of the curve with the operating characteristic point $\phi'$, $\phi'$ of the turbomachinery at the zero angle of the inlet guide vane is computed; and in step 5, the angle of the inlet guide vane is calculated according to the following equation.

$$\alpha=\arctan\,(k(\psi'-\psi)/\phi')$$

where k is a constant.

In step 6, the angle of the inlet guide vanes 6 is controlled; and in step 7, it is examined whether the value of the angle is zero (i.e. vane fully open). If the angle is not zero; then, in step 9, the flow rate is measured and the parameters $\phi''$, $\psi''$ are computed. Next, in step 10, it is examined whether the head is appropriate or not, and if the head value is inappropriate; in step 11, $\alpha'$ is computed; and in step 12, the quantity $(\alpha-\alpha')$ is computed, and the control step returns to step 6.

If the angle $\alpha$ in step 7 is zero and the turbomachinery is not provided with a rotational speed change capability, the control step returns to 1 to reset the operating parameters. If the turbomachinery is provided with a speed change capability, then the speed is changed in step 8, and the control step proceeds to step 9.

In step 10, if the head value is appropriate, the diffuser vanes 3*a* are controlled by the steps subsequent to step 13. In step 13, using the inlet flow volume measured in step 9, the diffuser vane angle is determined from the relationship between the non-dimensional inlet flow rate and the diffuser vane angle shown in FIG. 10. In step 14, the diffuser vane angle is changed. The flow rate and the head value after the change of the diffuser vane angle are measured; and in step 15, the values of $\phi''$, $\psi''$ are computed from the measured values. In step 16, it is examined whether the head H is the proper value, if the head value H is not proper, the control step returns to step 11.

Figure 10:
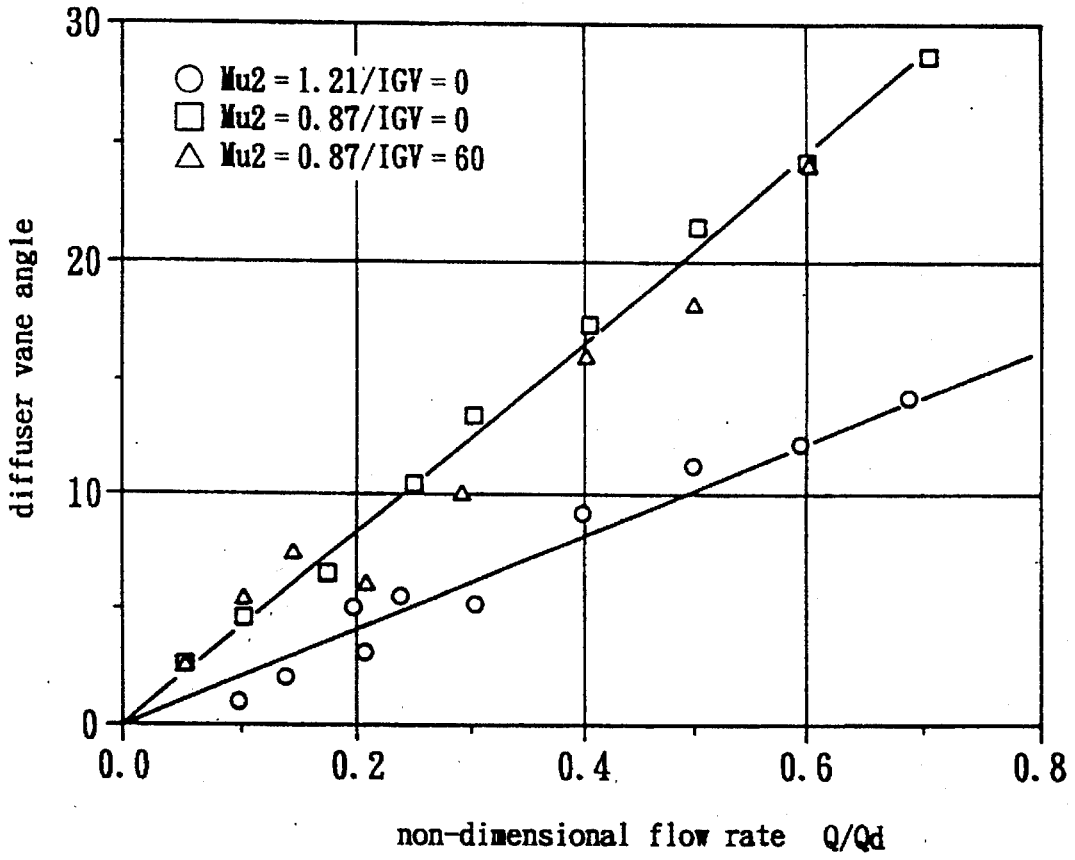
FIG. 10 shows the results of turbomachinery of the embodiment having the variable angle vanes.

The graph in FIG. 10 used in step 13 is a summary of the data obtained in the compressor, and shows the non-dimensional flow rate obtained by dividing the operational flow rate by the design flow rate on the x-axis, and the diffuser vanes angle on the y-axis. This graph shows the diffuser vane angles for the most stable operation of the compressor, achieved by varying the diffuser vane angle at the respective flow rates and rotational speeds. The stability of the flow was judged by the pressure changes registered in the pressure sensors disposed in pipes and the pump casing, for example.

FIG. 10 shows experimental results obtained in this investigation: the circles refer to those results when the rotational Mach number was 1.21 and the inlet guide vane was set at zero angle; the squares refer to those when the rotational Mach number was 0.87 and the inlet guide vane was set at zero angle; the triangles refer to those when the rotational Mach number was 0.87 and the inlet guide vane was set at 60 degrees.

Therefore, it can be seen that the diffuser vane angles for stable operation of the turbomachinery depends only on the fluid flow rate, and even if the inlet guide vane angle is changed, surge can be prevented by adjusting the diffuser vane angle approximately along the straight line. In can be seen also that the slope of the straight line is dependent on the rotational Mach number of the tip speed of the impeller, i.e., the rotational speed of the turbomachinery.

Figure 11:
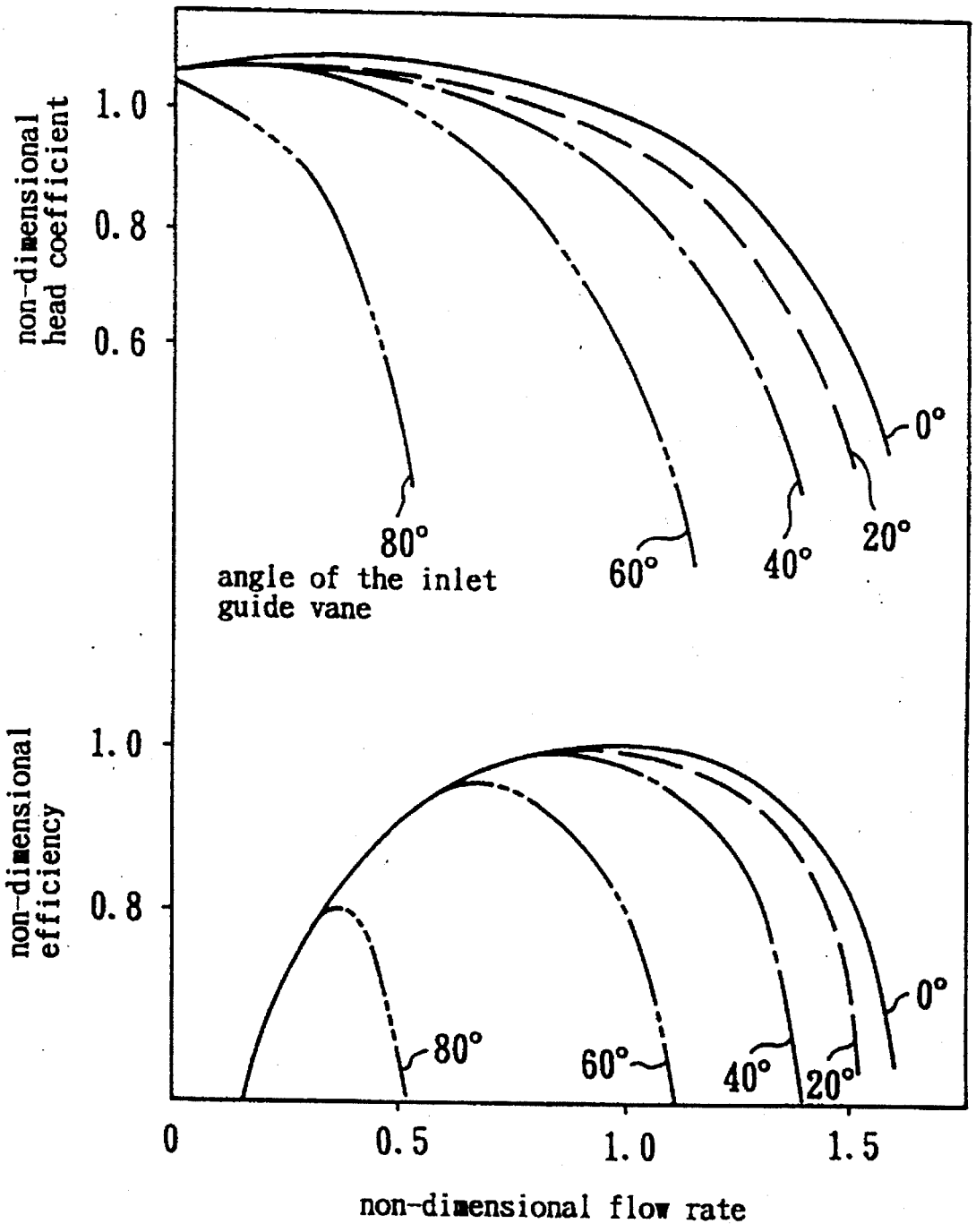
FIG. 11 shows the relationships between the non-dimensional flow rate and the non-dimensional head coefficient at various vane angles (top graph); and between the non-dimensional flow rate and non-dimensional efficiency at various vane angles (bottom graph) in the present turbomachinery.
Figure 12:
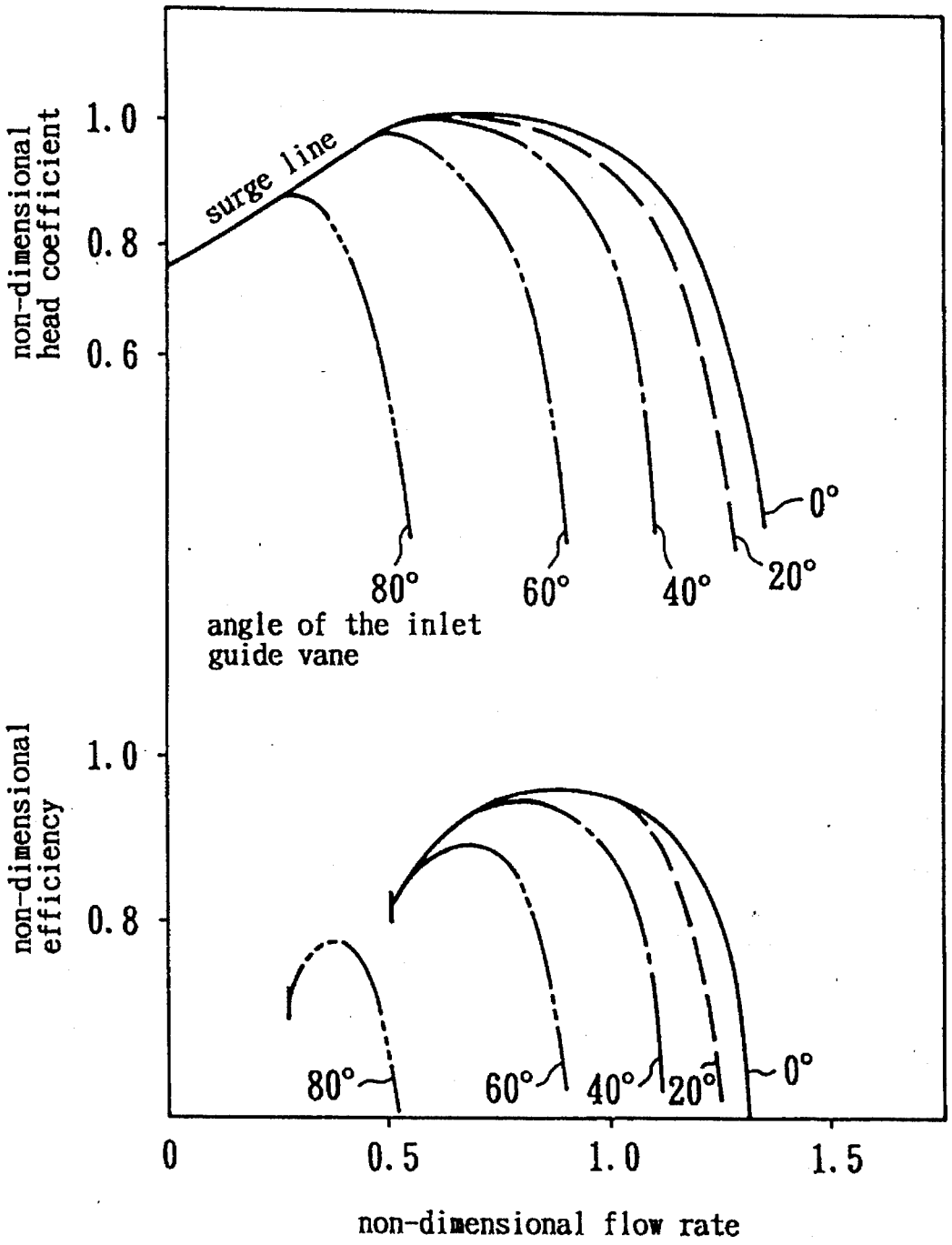
Fig. 12 PRIOR ART
FIG. 12 shows the relationships between the non-dimensional flow rate and non-dimensional head coefficient at various vane angles (top graph); and between the non-dimensional flow rate and the non-dimensional efficiency at various vane angles (bottom graph) in the conventional turbomachinery.

FIGS. 11 and 12 show a comparison of the overall performance characteristics of the conventional turbomachinery having a fixed angle diffuser vanes (FIG. 12) and the performance characteristics of the turbomachinery of the present invention provided with variable angle diffuser vanes (FIG. 11). It can be seen that the present turbomachinery is able to be operated stably even at low flow rates near the shut-off flow rate.

The embodiment presented in FIGS. 6 to 12 is based on a single unit of computing processor U, but it is permissible to provide separate computing processors for different computational requirements. Also, the drive controllers are separated into first, second and third drive controllers, but these functions can be served equally well with one controller.

What is claimed is:

1. A turbomachinery having variable angle flow guiding means comprising:

an impeller for providing energy to a fluid medium;

a diffuser vane assembly having variable angle vanes provided on a diffuser for increasing a fluid pressure of said fluid medium, said diffuser vane assembly receiving said fluid medium output from said impeller;

a rotation device for driving said diffuser vanes;

a flow rate detection device for detecting inlet flow rates;

a rotation device controller for operating said rotation device;

a storage medium accessed by said rotation device controller, said storage medium containing data representing a pre-determined relationship between inlet flow rates and diffuser vane angles which is determined so as to minimize instability of flow within said turbomachinery; and wherein said rotation device controller is operated to drive said rotation device to position said diffuser vanes at an operating angle.

2. A turbomachinery as claimed in claim 1, wherein said data is obtained through an experimental process.

3. A turbomachinery as claimed in claim 1, further comprising variable angle inlet guide vanes disposed upstream of said impeller, and a vane angle controller for controlling said variable angle inlet guide vanes to a selected vane angle when a specific head value is not attained.

4. A turbomachinery as claimed in claim 1, further comprising:

an inlet guide vane disposed upstream of said impeller;

an operating parameter input device for inputting operating parameters required for achieving a specified operating condition of said turbomachinery;

a computing processor for computing an operating angle of said inlet guide vane on a basis of an inlet flow rate and a head value measured by sensors so as to achieve said specified operating condition; and a drive controller for operating said inlet guide vane so as to position said inlet guide vane at said operating angle computed by said computing processor.

5. A turbomachinery as claimed in claim 4, wherein said computing processor determines said operating angle of said inlet guide vane on the basis of an intersection of a reference performance curve, defined by flow rate versus pressure coefficients, and a curve passing through a required operating point, in association with the flow rate versus pressure coefficients at said required operating point.

6. A turbomachinery having variable angle flow guiding means comprising:

an impeller for providing energy to a fluid medium;

a diffuser vane assembly having variable angle vanes provided on a diffuser for increasing a fluid pressure of said fluid medium, said diffuser vane assembly receiving said fluid medium output from said impeller;

a rotation device for driving said diffuser vanes;

a flow rate detection device for detecting inlet flow rates;

a rotation device controller for operating said rotation device;

a storage medium accessed by said rotation device controller, said storage medium containing data representing a pre-determined relationship between inlet flow rates and diffuser vane angles which is determined so as to minimize instability of flow within said turbomachinery; and wherein said rotation device controller is operated to drive said rotation device to position said diffuser vanes at an operating angle; and wherein said data is obtained through an experimental process in which said instability is represented by the amount of fluctuation of a detected value of a sensor arranged within said turbomachinery.

7. A turbomachinery as claimed in claim 6, wherein said data represents an approximately linear relationship between inlet flow rates and diffuser vane angles.

8. A turbomachinery as claimed in claim 7, wherein a slope of said approximately linear relationship between inlet flow rates and diffuser vane angles is governed by rotational speeds of said impeller.

9. A turbomachinery as claimed in claim 6, further comprising an impeller drive controller for controlling rotational speed of said impeller, wherein said impeller drive controller adjusts a rotational speed of said impeller when a specific head value is not attained.

10. A method of operating turbomachinery having variable angle flow guiding means to minimize instability of flow within said turbomachinery, comprising the steps of:

providing an impeller, and using said impeller for providing energy to a fluid medium;

providing a diffuser with a diffuser vane assembly having variable angle vanes provided on said diffuser, and using said diffuser vane assembly for increasing a fluid pressure of said fluid medium, said diffuser vane assembly receiving said fluid medium output from said impeller;

providing a rotation device and using said rotation device for driving said diffuser vanes;

providing a flow rate detection device and using said flow rate detection device for detecting inlet flow rates;

providing a rotation device controller for operating said rotation device;

providing a storage medium accessed by said rotation device controller, said storage medium containing data representing a pre-determined relationship between inlet flow rates and diffuser vane angles which is determined so as to minimize instability of flow within said turbomachinery; and operating said rotation device controller to drive said rotation device to position said diffuser vanes at an operating angle.

11. A method of operating turbomachinery as claimed in claim 10, wherein said data is obtained through a process in which said instability is represented by the amount of fluctuation of a detected value of a sensor arranged within said turbomachinery.

12. A method of operating turbomachinery as claimed in claim 10, wherein said data represents an approximately linear relationship between inlet flow rates and diffuser vane angles.

13. A method of operating turbomachinery as claimed in claim 12, wherein a slope of said approximately linear relationship between inlet flow rates and diffuser vane angles is governed by rotational speeds of said impeller.

* * * * *